US006445167B1

(12) United States Patent
Marty

(10) Patent No.: US 6,445,167 B1
(45) **Date of Patent: *Sep. 3, 2002**

(54) LINEAR REGULATOR WITH A LOW SERIES VOLTAGE DROP

(75) Inventor: Nicolas Marty, Claix (FR)

(73) Assignee: STMicroelectronics S.A., Gentilly (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/689,146

(22) Filed: Oct. 12, 2000

(30) Foreign Application Priority Data

Oct. 13, 1999 (FR) ..... 99 12978

(51) Int. Cl.[7] ..... G05F 1/40

(52) U.S. Cl. ..... 323/280; 323/316; 323/901; 323/281; 323/274

(58) Field of Search ..... 323/901, 316, 323/268, 274, 280, 281, 317

(56) References Cited

U.S. PATENT DOCUMENTS

| | | | | | |
|---|---|---|---|---|---|
| 4,972,136 | A | | 11/1990 | Banura | 323/275 |
| 5,004,986 | A | * | 4/1991 | Bohrer | 323/313 |
| 5,545,978 | A | | 8/1996 | Pontius | 323/313 |
| 5,666,044 | A | | 9/1997 | Tuozzolo | 323/277 |
| 5,698,973 | A | | 12/1997 | Goerke et al. | 323/901 |
| 6,020,727 | A | | 2/2000 | Bernard et al. | 323/269 |
| 6,150,800 | A | * | 11/2000 | Kinoshita et al. | 323/280 |

* cited by examiner

*Primary Examiner*—Shawn Riley
(74) *Attorney, Agent, or Firm*—Wolf, Greenfield & Sacks, P.C.; James H. Morris

(57) ABSTRACT

A linear regulator of the type including a power MOS transistor of a first channel type, controlled by an amplifier having an output stage including, between two supply terminals, a resistor and a first MOS control transistor of a second channel type. The regulator further includes a start-up circuit having a switchable resistor in parallel on said first resistor.

11 Claims, 4 Drawing Sheets

LINEAR REGULATOR WITH A LOW SERIES VOLTAGE DROP

BACKGROUND OF THE INVENTION

1. Field of the Invention

The present invention relates to linear voltage regulators intended for providing a regulated voltage from a reference voltage and a non-stabilized supply voltage. The present invention more specifically relates to regulators having a power element connected in series with the load to be supplied and that are designed to introduce a low series voltage drop (LDO) and to operate with a minimum supply voltage.

2. Discussion of the Related Art

FIG. 1 shows a conventional example of a linear regulator to which the present invention applies. Such a regulator is intended for supplying a load (Q) 2. The regulator is essentially formed of a power MOS transistor 1 intended for being connected in series with load 2. This series connection is connected between a terminal 3 for application of a more positive voltage Vbat and a terminal 4 for application of a more negative voltage (for example, the ground). Voltage Vbat is for example provided by a battery (not shown). Transistor 1 is controlled by a regulation circuit 5, generally based on a differential amplifier. A first inverting input of circuit 5 receives a reference voltage Vref and a second non-inverting input receives output voltage Vout, sampled at the junction point of transistor 1 and load 2. This junction point forms output terminal 6 of the regulator. A capacitor C is generally connected between terminal 6 and the ground to filter and stabilize output voltage Vout.

The operation of a regulator such as illustrated in FIG. 1 is perfectly conventional and will not be detailed. It should only be mentioned that amplifier 5 is, most often, supplied by voltage Vbat and that reference voltage Vref is generally provided by a reference circuit adapted to providing a steady and precise voltage, for example, a circuit of the bandgap type.

An example of application of linear regulators is the field of mobile phones. In this type of application, the telephone battery is used to supply one or several linear regulators that must, downstream, provide the necessary power supplies to the different biasing, control, and digital and analog processing circuits. Voltage Vout provided by the regulator must generally be very precise. For example, in an application to telephony, a precision of plus or minus 3% is desired.

Power transistor 1 is generally large since the regulator must operate over the entire current operating range of the circuits that it supplies downstream. For example, for a regulator that must be able to provide a current as high as 100 mA, the necessary surface area to form the power transistor is on the order of 1 mm2. The greatness of the required surface area is also due to the fact that, to respect the constraint of a low series voltage drop, the resistance of transistor 1 must be, in the on state (RdsON), as small as possible.

A consequence of the large bulk of the power transistor is that its gate capacitance is generally relatively high. For example, for a transistor of the type indicated hereabove as an example, a gate capacitance on the order of 100 picofarads is obtained.

A problem that is then raised is due to the occurrence of overvoltages at the regulator start-up. Indeed, when the circuit is off, the output voltage is null and amplifier 5 accordingly is not balanced.

When the circuit is powered on or, more precisely, when the regulator is turned on by a specific signal, transistor 1 then provides a high current to capacitor C being charged. As long as voltage Vout does not reach the desired output voltage Vref, amplifier 5 remains unbalanced. When voltages Vout and Vref become equal, the output terminal of amplifier 5 switches to stop the providing of a high current by transistor 1. However, due to the high gate capacitance of transistor 1, said gate is not immediately charged, which results in a delay in the circuit response. The output voltage then exceeds the desired value and an overvoltage appears.

This overvoltage must remain within acceptable limits according to the tolerances required for the output voltage. The higher the gate capacitance, the more difficult it is to fulfil this constraint.

The output stage (not shown in FIG. 1) of amplifier 5 is generally formed of an N-channel MOS transistor (more precisely, of a channel type opposite to that of the power transistor) in series with a current source. The current source is itself in parallel with a so-called gate resistor, the function of which precisely is to charge the gate capacitor of power transistor 1 when the amplifier output switches. The gate resistor is also used to set the amplifier gain and conditions the circuit stability. Another function of this resistor is to bias the output stage of amplifier 5. Accordingly, the value of this resistor also conditions the circuit switching. Now, of course, in applications where a high miniaturization is desired, it is also desired to minimize the power consumption for obvious reasons of autonomy.

Accordingly, it can be seen that it is not desirable to act upon this resistance, if it is not desired to see the regulator characteristics deteriorate in steady state.

SUMMARY OF THE INVENTION

The present invention aims at providing a novel solution that overcomes the problems of overvoltage upon start-up of conventional linear regulators.

The present invention aims, in particular, at providing a solution that is compatible with a low steady-state circuit consumption.

The present invention also aims at providing a solution that can be easily parameterized to set the circuit response time upon start-up.

A first solution would be to modify the voltage reference of the amplifier during the start-up. However, this solution is not desirable in practice since a same voltage reference is generally used by several linear regulators. Accordingly, modifying this reference would risk adversely affecting the operation of other regulators that would be in steady state.

The present invention aims at providing a solution that is compatible with an individualized operation of several regulators using a same voltage reference.

To achieve these and other objects, the present invention provides a linear regulator of the type including a power MOS transistor of a first channel type, controlled by an amplifier having an output stage including, between two terminals of application of a supply voltage, a first resistor and a first MOS control transistor of a second channel type, the regulator including a start-up circuit having a switchable resistor in parallel on said first resistor.

According to an embodiment of the present invention, the start-up circuit includes, in series between the source and the gate of the power MOS transistor, said switchable resistor and first and second MOS control transistors of the first channel type.

According to an embodiment of the present invention, the two MOS control transistors of the start-up circuit are on upon turning-on of the regulator, the turning-off of the first transistor being progressive by means of a control ramp.

According to an embodiment of the present invention, the second transistor of the start-up circuit is turned off at the end of the turn-off ramp of the first transistor.

According to an embodiment of the present invention, the duration of the turn-off ramp of the first transistor is chosen to be much greater than the time necessary, at the output of the linear regulator, to reach a desired voltage.

According to an embodiment of the present invention, the start-up circuit includes a ramp generator for controlling the first control transistor and a locking logic circuit to abruptly turn off the second control transistor at the end of the control ramp of the first transistor.

According to an embodiment of the present invention, the resistance of the start-up circuit is at least ten times smaller than the resistance of the output stage of the control amplifier.

According to an embodiment of the present invention, the power transistor has a P channel to form a positive voltage regulator.

According to an embodiment of the present invention, the power transistor has an N channel to form a negative voltage regulator.

The present invention also provides a method for controlling a linear regulator formed of a power MOS transistor and of a regulation amplifier having an output stage including, in series between two supply terminals, a resistor and a MOS control transistor of channel type opposite to that of the power transistor, the method including decreasing the value of said resistor upon start-up of the regulator.

According to an embodiment of the present invention, the method includes switching a resistor in parallel with the resistor of the output stage of the amplifier.

The foregoing objects, features and advantages of the present invention will be discussed in detail in the following non-limiting description of specific embodiments in connection with the accompanying drawings.

DETAILED DESCRIPTION

Figure 1:
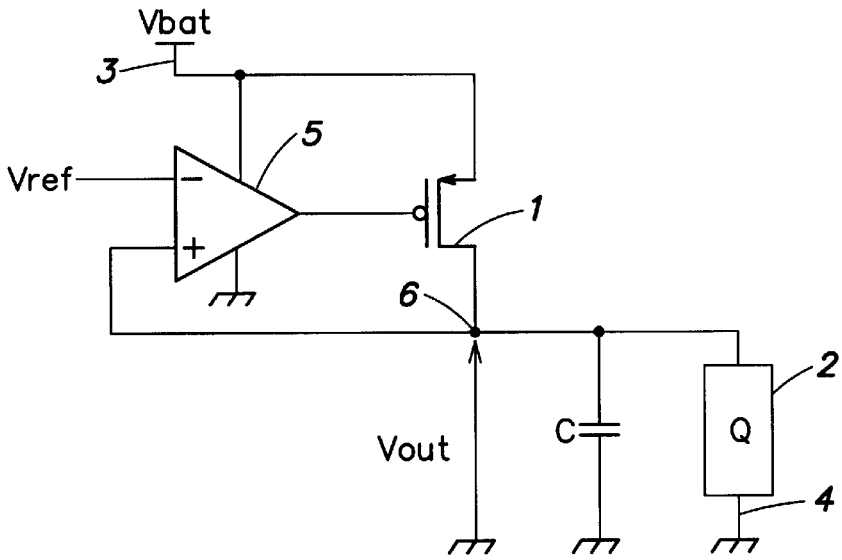
FIG. 1 (PRIOR ART)
FIG. 1, previously described, is meant to show the state of the art and the problem to solve.

The same elements have been designated with the same references in the different drawings. For clarity, only those elements that are necessary to the understanding of the present invention have been shown in the drawings and will be described hereafter. In particular, the structure of the differential amplifier of the regulator and the circuit providing the voltage reference of a linear regulator have not been detailed, since they are conventional.

A feature of the present invention is to provide, between the gate of the power transistor (for example, with a P channel) and the terminal (opposite to the load) of application of the supply voltage to which this transistor is forward connected, a switchable resistor. According to the present invention, this resistor is controlled to be inserted in the circuit upon start-up of the regulator only, and has a value smaller than that of the output stage resistor of the regulation amplifier.

Figure 2:
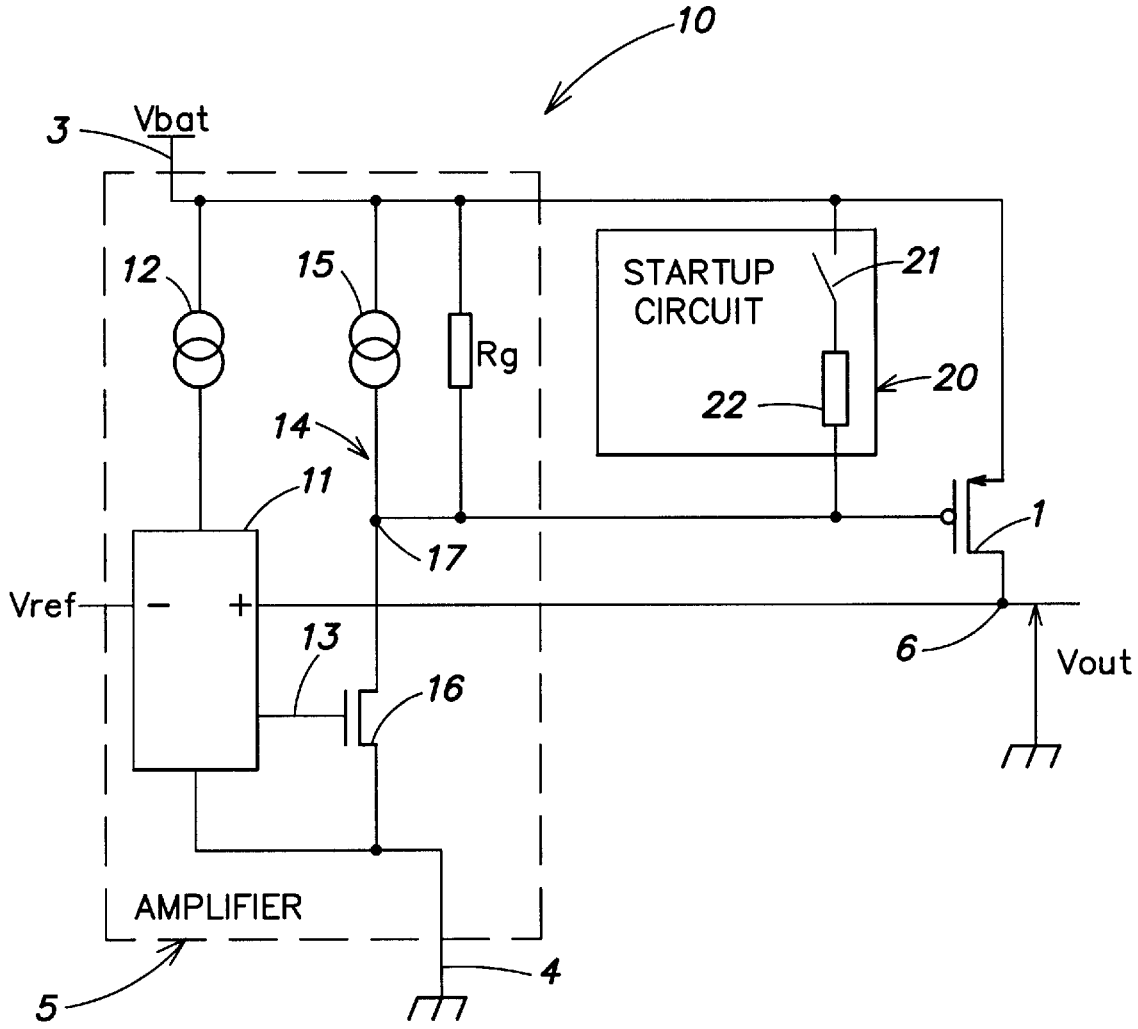
FIG. 2 very schematically shows a simplified embodiment of a linear regulator according to the present invention.

By inserting an additional resistor in parallel on the resistor determining the regulation amplifier gain, the value of resistor charging the power transistor gate is decreased and, accordingly, the charge of its gate capacitance upon start-up is accelerated. FIG. 2 very schematically shows a regulator 10 according to an embodiment of the present invention.

As previously, the regulator includes a regulation amplifier 5, connected between a terminal 3 of application of a positive voltage Vbat and ground 4, and which has the function of controlling a power MOS transistor 1, connected between terminal 3 and an output terminal 6 to which a load 2 is connected. Reference will be made hereafter to a linear regulator using a P-channel power MOS transistor and providing a positive voltage. It should however be noted that the present invention also applies to the case of a negative voltage regulator or of a regulator using an N-channel power MOS transistor.

Conventional amplifier 5 is essentially formed of a differential stage 11 receiving, on an inverting terminal, reference voltage Vref determining the value of the desired output voltage and, on a non-inverting terminal, output voltage Vout of the regulator sampled from drain 6 of transistor 1. A resistive bridge may be introduced between terminal 6 and the non-inverting input of amplifier 5, to obtain a voltage Vout greater than voltage Vref. Differential stage 11 is supplied by a current source 12 connected to terminal 3. Output 13 of the differential stage is sent onto an output stage 14 formed, in series between terminals 3 and 4, of a current source 15 and of a MOS transistor (here, with an N channel) 16, the gate of which is connected to terminal 13. The junction point 17 of current source 15 and of transistor 16 forms the output terminal of amplifier 5, connected to the gate of transistor 1. A resistor Rg, having the function of determining the gain of amplifier 5, of ensuring its stability, and of charging the gate of transistor 1, is connected in parallel on current source 15.

According to the present invention, a start-up circuit 20 functionally formed with a switch 21 in series with a resistor 22 is connected in parallel on resistor Rg. The value of resistor 22 is chosen to be small (preferably, with a ratio from 10 to 100) as compared to the value of resistor Rg. Thus, for a resistance Rg on the order of some hundred kΩ, a resistance 22 ranging between 1 and 10 kΩ will preferably be chosen.

When switch 21 is on, the parallel association of resistors Rg and 22 decreases the gate resistance of transistor 1 with respect to the simple value of resistor Rg, which decreases the charge time of the gate capacitor of transistor 1.

It should be noted that the control of the start-up circuit, that is, the switching of switch 21, must respect certain constraints. In particular, it will be ascertained not to reproduce, on the switching of this switch, the switching delay adversely affecting the operation of conventional regulators.

Thus, according to a preferred embodiment of the present invention, switch 21 is not just formed with a MOS transistor. Indeed, by providing a single MOS transistor in series with resistor 22, a disturbing transient effect risks being reproduced on this transistor, which again translates as a delay on the power transistor control.

Accordingly, another feature of the present invention is to associate, in series with resistor 22 of the start-up circuit, two switches (preferably, two MOS transistors) controlled in a particular way as will be seen hereafter.

Figure 3:
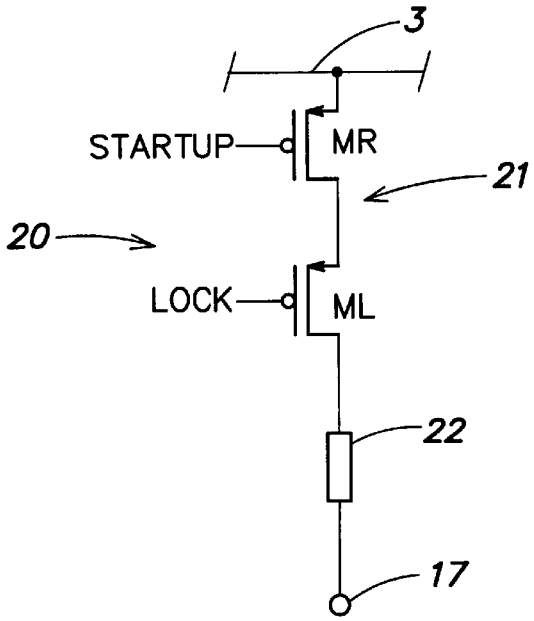
FIG. 3 shows a detail of a start-up circuit of a regulator according to an embodiment of the present invention.

FIG. 3 partially shows an embodiment of a start-up circuit according to the present invention, including a switch 21 in series with a resistor 22. Switch 21 here is formed, between terminal 3 and a first terminal of resistor 22, the second terminal of which is connected to terminal 17, of a first P-channel MOS transistor MR, in series with a second P-channel MOS transistor ML. Transistor MR is controlled by a signal STARTUP while transistor ML is controlled by a signal LOCK.

According to the present invention, signal STARTUP has the shape of a ramp, the function of which is to linearly control transistor MR for, after power-on, increasing its series resistance (RdsON), which adds to resistance 22, transistor ML being in a normally on quiescent state upon circuit power-on. Signal STARTUP is normally low so that, at the regulator start-up, transistor MR is on with a minimum series resistance (RdsON). The progressive increase of the series resistance of transistor MR progressively increases the value of the resistor in parallel on resistor Rg and, accordingly, causes a progressive turn-off switching of the start-up circuit of the present invention.

The turn-off control ramp of transistor MR must be sufficiently slow for the start-up to be over at the end of the ramp. In other words, it must be ascertained that capacitor C has reached the desired voltage level before the end of the turn-off ramp of transistor MR.

The function of transistor ML is to lock the opening of the start-up signal to avoid that a possible disturbance of battery voltage Vbat turns transistor MR back on under the effect of a parasitic conduction of the ramp generator, as will be seen hereafter.

Transistor ML is controlled by an edge, which is not disturbing since, when its turning-off is caused, the start-up circuit already is in practice turned off by transistor MR.

Figure 4:
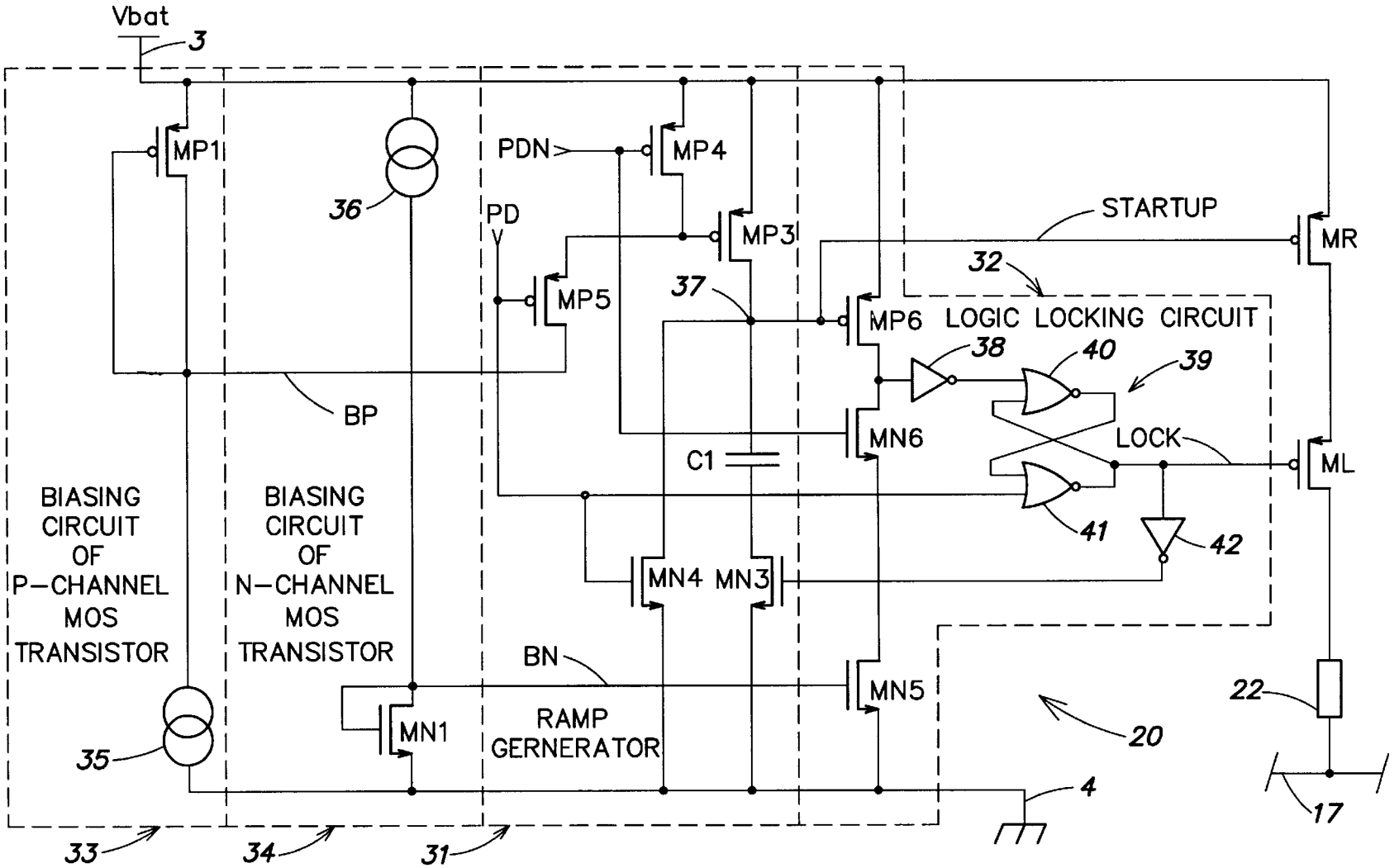
FIG. 4 is a detailed electric diagram of a start-up circuit according to an embodiment of the present invention.

FIG. 4 shows a preferred embodiment of a start-up circuit 20 according to the present invention. FIG. 4 shows not only the series association of transistors MR and NML forming switch 21 with resistor 22, but also the circuit for generating respective control signals STARTUP and LOCK of transistors MR and ML.

Circuit 20 is based on a ramp generator 31 providing signal STARTUP, associated with a logic locking circuit 32 for generating signal LOCK when signal STARTUP has reached its high state. In FIG. 4, stages 33, 34 providing biasing signals BP and BN of the respective P-channel and N-channel MOS transistors have also been shown as an example.

Circuit 20 of the present invention is intended for being exclusively controlled by the activation signal of the linear regulator. This signal is formed of a logic signal PD and of its inverse PDN. In FIG. 4, the inversion mechanism of turn-off signal PD or turn-on signal PDN has not been shown.

Biasing circuit 33 is, for example, formed, in series between terminals 3 and 4, of a P-channel MOS transistor MP1 and of a current source 35. Transistor MP1 is diode-mounted, its source being connected to terminal 3 and its drain being connected to the first terminal of current source 35, the other terminal of which is connected to ground 4. The drain of transistor MP1 is also connected to its gate and to the drain of transistor MP5, and forms the output terminal of circuit 33 providing signal BP. Current source 35 is, for example, formed of a resistor or of a properly biased N-channel MOS transistor.

Biasing circuit 34 is, for example, formed, in series between terminal 3 and terminal 4, of a current source 36 and of an N-channel MOS transistor MN1. Transistor MN1 is diode-mounted, its source being connected to terminal 4 and its drain being connected to a first terminal of current source 36, the other terminal of which is connected to terminal 3. The drain of transistor MN1 is also connected to its gate and to the gate of transistor MN5, and forms the output terminal of circuit 34 providing signal BN. Current source 36 is, for example, formed of a resistor or of a properly biased P-channel MOS transistor.

When the system is powered, that is, when a voltage Vbat is applied between terminals 3 and 4, signals BP and BN are, respectively, substantially at voltages Vbat-Vtp (Vtp represents the threshold voltage of a P-channel MOS transistor) and Vtn (Vtn represents the threshold voltage of an N-channel MOS transistor).

According to the embodiment of the present invention illustrated in FIG. 4, ramp generator 31 is based on the use, in series between terminals 3 and 4, of a P-channel MOS transistor MP3, associated with a capacitor C1 and, for the locking, as will be seen hereafter, with an N-channel MOS transistor MP3. The source of transistor MP3 is connected to terminal 3. Its drain is connected to a first terminal of capacitor C1 that determines the time constant of the ramp. The other terminal of capacitor C1 is connected to the drain of transistor MN3, the source of which is grounded. The gate of transistor MN3 is connected, via a P-channel MOS transistor MP4, to terminal 3. Transistor MP4 is controlled by signal PDN and its drain is further connected to the gate of transistor MP3, connected to the source of a P-channel MOS transistor MP5, the drain of which receives signal BP and the gate of which receives signal PD. The drain of transistor MP3, which forms output terminal 37 of ramp generator 31, is further connected, via an N-channel MOS transistor MN4, controlled by signal PD, to terminal 4.

The function of transistor MP4 is to force, by being on, the turning-off of transistor MP3 when signal PDN is low, that is, when the regulator is off.

The function of transistor MP5 conversely is to force the turning-on of transistor MP3 by being on when signal PD is low, that is, when the regulator is on.

The function of transistor MN4 is to short-circuit capacitor C1 and transistor MN3 when signal PD is high, that is, when the regulator is off.

Signal STARTUP, provided by output terminal 37 of ramp generator 31, is directly sent onto the gate of transistor MR and to the input of locking circuit 32.

Circuit 32 includes, in series between terminals 3 and 4, a P-channel MOS transistor MP6 and two N-channel MOS transistors MN5 and MN6. The source of transistor MP6 is connected to terminal 3. Its gate receives signal STARTUP. Its drain is connected to the drain of transistor MN6, the gate of which receives signal PDN. The source of transistor MN6 is connected to the drain of transistor MN5, the source of which is connected to terminal 4 and the gate of which receives signal BN. The common drain of transistors MP6 and MN6 is further connected to the input of an inverter 38, the output of which is sent onto a flip-flop 39 formed, for example, of two NOR-type gates 40 and 41. The output of inverter 38 is sent onto a first input of gate 41. The output of gate 41 forms the output of flip-flop 39, sent onto the second input of gate 40. The second input of gate 41 receives signal PD. The output of flip-flop 39 provides signal LOCK. The output of flip-flop 39 is also, preferably, sent via an inverter 42 onto the gate of transistor MN3.

The function of transistor MN3 is to avoid a permanent consumption, outside start-up periods, by isolating the ramp generator when signal LOCK switches high.

The function of transistor MP6 is to open the input branch of circuit 32 when the regulator is off and to thus suppress the consumption in circuit 32.

It should be noted that neither the details constitutive of the inverters and logic gates of circuit 32, nor current sources 35 and 36 have been described, since they are perfectly conventional.

Figure 5A:
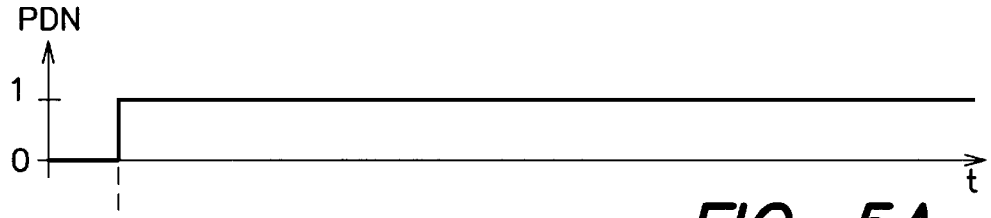
FIGS. 5A to 5F illustrate, in the form of timing diagrams, the operation of a linear regulator according to the present invention.
Figure 5B:
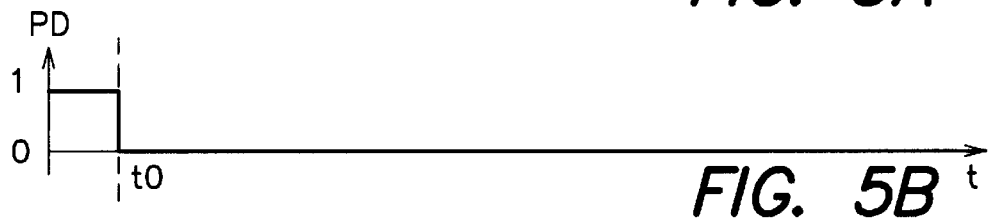
Figure 5C:
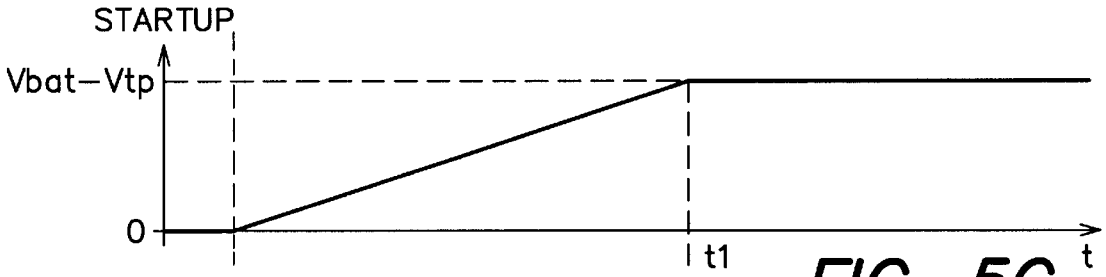
Figure 5D:
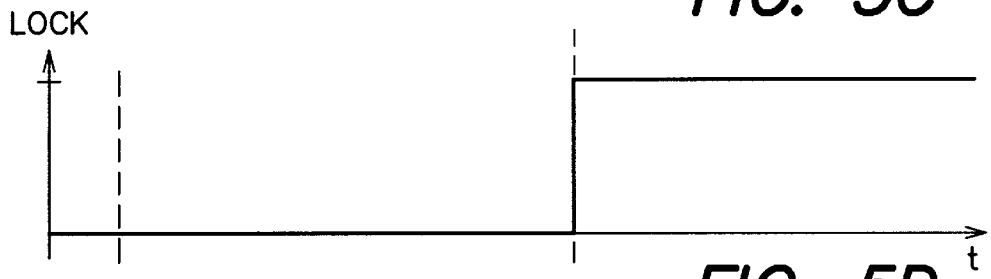
Figure 5E:
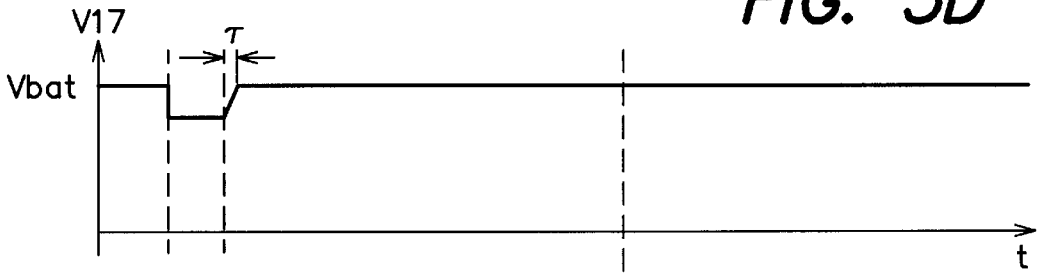
Figure 5F:
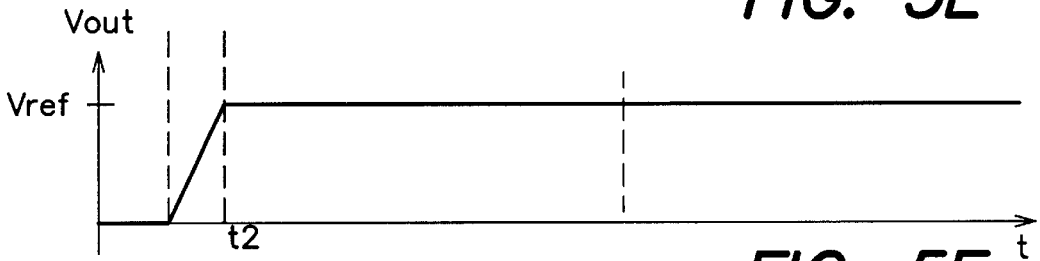

The operation of the circuit shown in FIG. 4 is illustrated in FIGS. 5A to 5F that show, in the form of timing diagrams, an example of shape of signals characteristic of a regulator according to the present invention. FIG. 5A shows the shape of signal PDN. FIG. 5B shows the shape of signal PD. FIG. 5C shows the shape of signal STARTUP. FIG. 5D shows the shape of signal LOCK. FIG. 5E shows the shape of gate signal V17 of power transistor 1 of the regulator. FIG. 5F shows the shape of output voltage Vout of the regulator.

Initially, that is, when the regulator is off, signals PDN and PD are respectively low and high. Point 37 is grounded by transistor MN4 that is on and signal STARTUP thus is low. Transistor MR is thus on. Similarly, transistor MP6 is turned on by the low state of node 37 while transistor MN6 is turned off by the low state of signal PDN. This results in a high level at the input of inverter 38 and, accordingly, in a low state at the output of flip-flop 39, that is, at the input of inverter 42. Transistor ML thus is on, signal LOCK being low. Further, transistor MN3 is also on. Ramp generator 31 is thus ready to operate.

It is assumed that at a time t0, signals PD and PDN switch to turn on the regulator, that is, signal PD switches low while signal PDN switches high. This results, on locking circuit 32, in a switching to the low state of the first external input of flip-flop 39 (the second input of gate 41). The output of flip-flop 39 however does not switch states (the output of gate 40 being still high) as long as its second external input, that is, the input of gate 40 connected to the output of inverter 38, does not switch states. Transistor MN3 thus remains on.

On the ramp generator side, transistor MP4 is turned off by the switching of signal PDN to the high state. Further, transistor MP5 is turned on by the switching to the low state of signal PD. As a result, transistor MP3 turns on, the current in transistor MP3 being determined by the current in transistor MP1, and thus by signal BP. Since transistor MN4 is blocked at time to by the switching to the low state of signal PD, capacitor C1 is charged by transistor MP3. As long as transistor MP3 is saturating, it provides a constant charge current to capacitor C1. Circuit 33 and, more specifically, the sizes of transistors MP1 and MP5, are chosen adequately for transistor MP3 to be saturating. The charge of capacitor C1 under a constant current effectively causes an increasing current ramp on the gate of transistor MR (FIG. 5C), and thus a progressive opening of this transistor by increase of its series resistance (RdsON).

When the potential of node 37 reaches voltage Vbat-Vtp (time t1, FIG. 5C), the output of flip-flop 39 switches. Indeed, transistor MP6 turns off. Since transistor MN6 is on due to signal PDN being high and transistor MN5 is also on as soon as the system is powered, the input of inverter 38 switches low. Its output switches high and the output of gate 40 thus switches low. The output of gate 41 switches high and, by the looping back on the input of gate 40, the state then obtained is steady. The high output of flip-flop 39 (signal LOCK) turns off transistor ML. This turning-off of transistor ML occurs when transistor MR itself is already completely turned off by the ramp of signal STARTUP.

At time t1, transistor MN3 is turned off by the switching to the high state of the output of flip-flop 39, inverted by inverter 42, so that ramp generator 31 is disconnected. The function of flip-flop 39 actually is to memorize the state of signal STARTUP for the first time that, after turning-on of the regulator, signal STARTUP comes close to voltage Vbat.

Should voltage Vbat undergo variations while the regulator is in steady state, these variations could cause a recharge of capacitor C1 and a new turning-off of transistors MR and ML, which would disturb the steady state operation. Due to transistors MN3 and MN4, the voltage on node 37 can no longer vary once signal LOCK has switched high, as long as signal PD does not switch, that is, as long as the turning back on is not provoked.

Upon turning-off of the regulator, when signal PD switches back to the high state, transistor MN4 discharges capacitor C1 of the ramp generator, to place it back to a correct operating position for the next turning-on.

It should be noted that, when transistor MP6 is turned off at time t1, there is no further consumption in flip-flop 39 and in ramp generator 31. The only consumption comes from transistors MP1 and MN1. However, these transistors are generally in a biasing block of the general circuit that generates voltages BP and BN that can be used by other circuits. The consumption of biasing circuits 33 and 34 must thus be considered as being external to the regulator.

FIG. 5E illustrates the shape of voltage V17 on the gate of transistor 1. At time t0, voltage V17 appears to drop to turn on transistor 1. Capacitor C thus charges under a strong current, which results in an increase of voltage Vout. When voltage Vout reaches reference voltage Vref (time t2, FIG. 5F), amplifier 5 (FIG. 2) switches and transistor 1 turns off. Since this occurs at the beginning of the ramp of signal STARTUP, resistor 22 is then fully in parallel with resistor Rg, which considerably accelerates the turning-off of transistor 1 with respect to the conventional circuit. Time T, required to turn off transistor 1, is equal to Cg*RgR22/(Rg+R22), where R22 and Rg are the respective values of resistors 22 and Rg, and where Cg designates the gate capacitance of transistor 1. Preferably, the value of resistor 22 is chosen to be at least ten times greater than resistor Rg of the output stage of the control amplifier, to minimize time r.

An advantage of the present invention is that it enables avoiding overvoltages at the powering-on of a linear regulator.

Another advantage of the present invention is that it does not require other control signals than those usually available for the control of a regulator. Indeed, as appears from FIG. 4, the only signals required for the operation of the start-up circuit are signals PD and PDN used to turn on/off the regulator.

Another advantage of the present invention is that it causes no additional consumption in the regulator in steady state.

Of course, the present invention is likely to have various alterations, modifications, and improvements which will readily occur to those skilled in the art. In particular, the sizing of the different components may be chosen by those skilled in the art according to the application and, in particular, according to the desired currents and to the desired ramp time for the start-up circuit. Further, although the present invention has been described hereabove in relation with a regulator using a P-channel power MOS transistor, adapting the start-up circuit of the present invention to a regulator using an N-channel power MOS transistor is within the abilities of those skilled in the art based on the functional indications given hereabove. Similarly, adapting the start-up circuit and the regulator for providing a negative voltage is within the abilities of those skilled in the art.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A linear regulator including a power MOS transistor of a first channel type, controlled by an amplifier having an output stage including, between two supply terminals, a first resistor and a first MOS control transistor of a second channel type, further including a start-up circuit having a switchable resistor in parallel with said first resistor.

2. The regulator of claim 1, wherein the start-up circuit includes, in series between a source and a gate of the power MOS transistor, said switchable resistor and first and second MOS control transistors of a first channel type.

3. The regulator of claim 2, wherein the first and second MOS control transistors of the start-up circuit are on upon turning-on of the regulator, the turning-off of the first MOS control transistor being progressive by means of a control ramp.

4. The regulator of claim 3, wherein the second MOS control transistor of the start-up circuit is turned off at the end of the control ramp of the first MOS control transistor.

5. The regulator of claim 3, wherein a duration of the control ramp of the first MOS control transistor is chosen to be much greater than a time necessary, at an output of the linear regulator, to reach a desired voltage.

6. The regulator of claim 3, wherein the start-up circuit includes a ramp generator for controlling the first MOS control transistor and a locking logic circuit to abruptly turn off the second MOS control transistor at the end of the control ramp of the first MOS control transistor.

7. The regulator of claim 1, wherein a resistance of the switchable resistor is at least ten times smaller than a resistance of the first resistor.

8. The regulator of claim 1, wherein the power MOS transistor has a P channel to form a positive voltage regulator.

9. The regulator of claim 1, wherein the power MOS transistor has an N channel to form a negative voltage regulator.

10. A method for controlling a linear regulator formed of a power MOS transistor and of a regulation amplifier having an output stage including, in series between two supply terminals, a resistor and a MOS control transistor of channel type opposite to that of the power MOS transistor, including decreasing the value of said resistor upon start-up of the regulator.

11. The method of claim 10, including switching the resistor in parallel with a second resistor of the output stage of the amplifier.

* * * * *

UNITED STATES PATENT AND TRADEMARK OFFICE

CERTIFICATE OF CORRECTION

PATENT NO. : 6,445,167 B1
DATED : September 3, 2002
INVENTOR(S) : Nicolas Marty

It is certified that error appears in the above-identified patent and that said Letters Patent is hereby corrected as shown below:

Column 6,
Line 33, should read -- of transistor MP3 is connected, via a P-channel MOS --

Signed and Sealed this

Thirty-first Day of December, 2002

JAMES E. ROGAN
*Director of the United States Patent and Trademark Office*